US008704434B2

(12) United States Patent
Moritani et al.

(10) Patent No.: US 8,704,434 B2
(45) Date of Patent: Apr. 22, 2014

(54) SPARK PLUG AND METHOD OF MANUFACTURING THE SAME

(71) Applicant: NGK Spark Plug Co., Ltd., Nagoya (JP)

(72) Inventors: Kenji Moritani, Konan (JP); Hiroaki Nasu, Gifu (JP); Makoto Sugita, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/914,804

(22) Filed: Jun. 11, 2013

(65) Prior Publication Data

US 2013/0334954 A1 Dec. 19, 2013

(30) Foreign Application Priority Data

Jun. 12, 2012 (JP) ..... 2012-132766

(51) Int. Cl.
*H01T 13/04* (2006.01)

(52) U.S. Cl.
USPC ..... 313/135; 445/7; 313/143

(58) Field of Classification Search
USPC ..... 313/143, 135, 118; 445/7
See application file for complete search history.

(56) References Cited

U.S. PATENT DOCUMENTS

| | | | | |
|---|---|---|---|---|
| 1,511,739 | A * | 10/1924 | McDowell | 123/169 PA |
| 2,651,298 | A * | 9/1953 | Brinson et al. | 313/135 |
| 3,488,545 | A * | 1/1970 | Wright | 313/143 |
| 4,646,695 | A * | 3/1987 | Blackburn | 123/256 |
| 5,799,637 | A * | 9/1998 | Cifuni | 123/266 |
| 6,548,945 | B1 | 4/2003 | Tamura | |
| 7,893,604 | B2 | 2/2011 | Takeuchi et al. | |
| 7,923,910 | B2 * | 4/2011 | Nakamura et al. | 313/143 |
| 8,206,194 | B2 * | 6/2012 | Mori et al. | 445/7 |
| 8,471,448 | B2 * | 6/2013 | Katsuraya et al. | 313/118 |
| 2008/0061670 | A1 * | 3/2008 | Nakayama et al. | 313/143 |
| 2008/0092838 | A1 | 4/2008 | Takeuchi et al. | |
| 2009/0071429 | A1 * | 3/2009 | Nakayama et al. | 123/169 R |
| 2010/0141110 | A1 * | 6/2010 | Nakamura et al. | 313/143 |
| 2010/0301733 | A1 * | 12/2010 | Kaiser et al. | 313/143 |
| 2011/0273074 | A1 * | 11/2011 | Yamada et al. | 313/135 |

FOREIGN PATENT DOCUMENTS

| | | | |
|---|---|---|---|
| JP | 4092826 | B2 | 3/2008 |
| JP | 2008-108478 | A | 5/2008 |

* cited by examiner

*Primary Examiner* — Nimeshkumar Patel
*Assistant Examiner* — Glenn Zimmerman
(74) *Attorney, Agent, or Firm* — Leason Ellis LLP.

(57) ABSTRACT

A spark plug includes an insulator extending along an axis and a metal shell provided on the outer periphery of the insulator. The metal shell includes a thread portion for threadedly engaging with a mounting hole of an internal combustion engine and a seat portion having a tapered surface whose outer diameter decreases gradually toward a leading end side. The tapered surface contacts with a bearing surface of the internal combustion engine when the thread portion is engaged with the mounting hole. Annular protruding portions or a helical protruding portion are formed within a range on the tapered surface from an outermost peripheral portion to a part forming an outer diameter occupying 95% of the diameter of the outermost peripheral portion. The arithmetic mean roughness of a surface of the tapered surface within the range is set to 1-5 μm on a section including the axis.

16 Claims, 10 Drawing Sheets

SPARK PLUG AND METHOD OF MANUFACTURING THE SAME

CROSS-REFERENCE TO RELATED PATENT APPLICATIONS

This application claims the benefit of priority to the Japanese Patent Application No. 2012-132766, filed on Jun. 12, 2012, the entire contents of which are incorporated herein by reference.

FIELD OF THE INVENTION

The present invention relates to a spark plug used in an internal combustion engine, or the like, and a method of manufacturing the spark plug.

BACKGROUND OF THE INVENTION

A spark plug, by being mounted in a combustion device such as an internal combustion engine, is used for igniting a mixture or the like. In general, the spark plug includes an insulator having an axial hole extending in a direction of the axis, a center electrode inserted in a leading end side portion of the axial hole, and a metal shell provided on the outer periphery of the insulator. Also, a thread portion for threadedly engaging with a mounting hole of the combustion device, and a flanged seat portion, formed closer to a rear end side than the thread portion, which protrudes radially outward, are formed on the outer peripheral surface of the metal shell.

Furthermore, a technology is known wherein, in order to ensure airtightness in a combustion chamber, a ring-shaped gasket is provided around the neck of the thread portion, and the gasket is brought into contact with a bearing surface of the combustion device when the spark plug is mounted in the combustion device (for example, refer to JP-A-2008-108478). In addition, a technique wherein a leading end face of the seat portion is formed into a tapered surface tapering toward a leading end side in the direction of the axis, rather than providing the gasket, and the tapered surface is brought into direct contact with the bearing surface, is proposed for the standpoint of realizing more superior airtightness. With a configuration of bringing the tapered surface into contact with the bearing surface in this way, the tapered surface is formed in a flat and smooth shape with extremely few irregularities, and a wide range on the tapered surface is brought into contact with the bearing surface, thereby promising a further improvement in airtightness (for example, refer to Japanese Patent No. 4,092,826).

However, with the configuration of forming the tapered surface in a flat and smooth shape, as heretofore described, there is fear that airtightness decreases drastically simply by minute marks being formed on the tapered surface during a manufacturing process, a conveyance of the spark plug, or the like. Consequently, it is necessary to carry out a management of the tapered surface with extreme caution during the manufacturing process, conveyance, or the like, thus resulting in inferior productivity and manageability.

SUMMARY OF THE INVENTION

The invention, having been contrived bearing in mind the heretofore described circumstances, has an object of ensuring good airtightness while realizing superior productivity and manageability in a spark plug of a type wherein a tapered surface comes into contact with a bearing surface when the spark plug is mounted in a combustion device.

Hereafter, an itemized description will be given of each configuration suitable for achieving the object. Working effects specific to the corresponding configurations are quoted as necessary.

Configuration 1. A spark plug of this configuration includes a hollow cylindrical insulator extending in a direction of an axis; and a hollow cylindrical metal shell provided on the outer periphery of the insulator. The metal shell has a thread portion for threadedly engaging with a mounting hole of a combustion device; and a flanged seat portion, having a tapered surface whose outer diameter decreases gradually toward a leading end side, which is positioned closer to a rear end side than the thread portion, and the tapered surface comes into contact with a bearing surface of the combustion device when the thread portion is threadedly engaged with the mounting hole of the combustion device. Annular protruding portions, or a helical protruding portion having the length of one or more turns, extending in a circumferential direction of the metal shell, is formed within at least a range on the tapered surface from an outermost peripheral portion to a part forming an outer diameter occupying 95% of the outer diameter of the outermost peripheral portion, and the arithmetic mean roughness of a surface of the tapered surface within the range is set to 1 μm or more and 5 μm or less on a section including the axis.

In general, with the spark plug mounted in the combustion device in a condition in which no deformation has occurred in the bearing surface, an acute angle (the inclination angle of the bearing surface) of angles formed by the visible outline of the bearing surface and the axis on the section including the axis is smaller than an acute angle (the inclination angle of the tapered surface) of angles formed by the visible outline of the tapered surface and the axis. Consequently, when the spark plug is mounted in the combustion device, a part (an outer periphery side region) of the tapered surface positioned within the range from the outermost peripheral portion to the part forming the outer diameter occupying 95% of the outer diameter of the outermost peripheral portion comes into contact with the bearing surface of the combustion device. That is, the outer periphery side region is a particularly important part in terms of maintaining airtightness in a combustion chamber.

According to the configuration 1, the arithmetic mean roughness of a surface in the outer periphery side region is set to 1 μm or more on the section including the axis, thus allowing the existence of some irregularities. Consequently, not much difference occurs in the condition of the tapered surface even though minute marks are formed on the tapered surface, and it is not necessary to carry out the management of the tapered surface with particular caution during a manufacturing process, conveyance, or the like. As a result of this, it is possible to realize superior productivity and manageability.

Meanwhile, by the arithmetic mean roughness of the surface in the outer periphery side region being set to 1 μm or more, there is concern that the close contact of the tapered surface with the bearing surface is impaired, thus resulting in insufficient airtightness. In this regard, according to the configuration 1, the helical protruding portion with one or more turns, or the annular protruding portions, extending in the circumferential direction of the metal shell, are formed in the outer periphery side region. Consequently, when the spark plug is mounted in the combustion device, it is possible to bring particularly the helical protruding portion or annular protruding portions of the tapered surface into comparatively high pressure contact with the bearing surface. Furthermore, as the protruding portion or protruding portions in comparatively high pressure contact form a helical shape with one or more turns or an annular shape respectively, it is possible to more reliably seal a space between the bearing surface and tapered surface over the whole circumference. As a result of this, it is possible to ensure superior airthightness.

In order to more reliably realize superior airtightness, it is preferable that the arithmetic mean roughness of the surface in the outer periphery side region is set to 5 μm or less.

Configuration 2. In this configuration, the spark plug according to the configuration 1 is such that the annular protruding portions or helical protruding portion is formed in the whole area of the tapered surface, and the arithmetic mean roughness of the surface of the tapered surface is set to 4 μm or more and 5 μm or less.

The "whole area of the tapered surface" refers to the whole area of a part of the tapered surface which can come into contact with the bearing surface. For example, a range on the tapered surface from the outermost peripheral portion to a part forming an outer diameter equal to the size of the thread portion may be referred to as the whole area of the tapered surface.

According to the configuration 2, the helical protruding portion or annular protruding portions are formed in the whole area of the tapered surface. Because of this, it is possible to bring the helical protruding portion or annular protruding portions formed in any position into contact with the bearing surface even when a deformation occurs in the bearing surface by repeatedly carrying out a mounting and dismounting of the spark plug in and from the combustion device. For example, in a condition in which it is difficult for the helical protruding portion or annular protruding portions formed in the outer periphery side region to come into contact with the bearing surface as a result of the deformation of the bearing surface, the helical protruding portion or annular protruding portions formed on the inner periphery side of the outer periphery side region come into contact with the bearing surface. That is, according to the configuration 2, it is possible to maintain good airtightness even when a deformation occurs on the bearing surface by carrying out a plurality of times of mounting of the spark plug.

Configuration 3. In this configuration, the spark plug according to the configuration 1 is such that the size of the thread portion is M14 or less.

With the spark plug with the size of the thread portion set to M14 or less, as in the configuration 3, the area of the tapered surface is comparatively small. Consequently, the area of the tapered surface in contact with the bearing surface is also small, and there is concern about a decrease in airtightness. However, by employing the configuration 1 or the like, with the spark plug with the size of thread set to M14 or less too, it is possible to realize superior airtightness. In other words, the configuration 1 or the like is particularly significant for the spark plug with the size of thread set to M14 or less.

Configuration 4. In this configuration, the spark plug according to the configuration 1 is such that the size of the thread portion is M12 or less.

With the spark plug with the size of the thread portion set to M12 or less, as in the configuration 4, as the area of the tapered surface in contact with the bearing surface is smaller, there is more concern about a decrease in airtightness. However, by employing the configuration 1 or the like, it is possible to realize superior airtightness even with the spark plug with the size of thread set to M12 or less. In other words, the configuration 1 or the like is extremely significant for the spark plug with the size of thread set to M12 or less.

Configuration 5. This configuration is a method of manufacturing a spark plug including a hollow cylindrical insulator extending in a direction of an axis; and a hollow cylindrical metal shell provided on the outer periphery of the insulator. The metal shell has a thread portion for threadedly engaging with a mounting hole of a combustion device; and a flanged seat portion, having a tapered surface whose outer diameter decreases gradually toward a leading end side, which is positioned closer to a rear end side than the thread portion, and the tapered surface comes into contact with a bearing surface of the combustion device when the thread portion is threadedly engaged with the mounting hole of the combustion device. The method includes a pressing step which, using a receiving die having an insertion hole into which the thread portion can be inserted and an annular receiving surface continuing with an opening of the insertion hole, presses the tapered surface against the receiving surface by pressing the metal shell toward the receiving die side while inserting the thread portion into the insertion hole. At least one portion of a part of the receiving surface against which the tapered surface is pressed, the arithmetic mean roughness of the surface of which is set to 1 μm or more and 5 μm or less, includes at least either annular protrusion portions and depression portions, or a helical protrusion portion and depression portion having the length of one or more turns, extending in a circumferential direction of the receiving surface. In the pressing step, by pressing the tapered surface against the receiving surface, annular protruding portions, or a helical protruding portion having the length of one or more turns, extending in a circumferential direction of the metal shell, is formed on the tapered surface.

In a step of forming a crimped portion in a rear end portion of the metal shell, or the like, as in a configuration 6 to be described next, there is a case in which the tapered surface is pressed against the receiving surface by pressing the metal shell toward the receiving die side, after inserting the thread portion into the insertion hole, using the receiving die having the annular receiving surface continuing with the opening of the insertion hole. Herein, a friction force generated between the receiving surface and tapered surface is very small when the tapered surface is formed in a flat and smooth shape with extremely few irregularities in order to improve airtightness. Consequently, the tapered surface becomes liable to slip on the receiving surface when pressing the metal shell, and the metal of the seat portion is thus liable to enter (bite into) the insertion hole. When a bite of the metal shell into the receiving die occurs, there is fear that additional work is required when removing the metal shell from the receiving die, thus causing a decrease in productivity. Also, the metal of the seat portion enters the insertion hole, thereby resulting in a large mark on the seat portion, as a result of which there is fear that yield decreases.

In this regard, according to the configuration 5, at least one portion of a part of the receiving surface against which is pressed the tapered surface is such that the arithmetic mean roughness of the surface thereof is set to 1 μm or more. Consequently, it is possible to sufficiently increase a friction force generated between the receiving surface and tapered surface, and it is possible to suppress slippage of the tapered surface on the receiving surface when pressing the metal shell. As a result of this, it is possible to prevent the metal shell from biting into the receiving die, and it is possible to improve productivity and yield.

Also, although it is possible to suppress slippage of the tapered surface on the receiving surface when the part of the receiving surface against which is pressed the tapered surface is simply unleveled, irregularities are formed on the tapered surface after the pressing step, and there is fear that the close contact of the tapered surface with the bearing surface is impaired when the manufactured spark plug is mounted in the combustion device, thus resulting in insufficient airtightness. However, according to the configuration 5, at least one portion of a part of the receiving surface against which the tapered surface is pressed includes at least either the helical protrusion portion and depression portion having the length of one or more turns, or the annular protrusion portions and depression portions, extending in the circumferential direction of the receiving surface. Consequently, the helical protruding portion having the length of one or more turns, or the annular protruding portions, extending in the circumferential direction of the metal shell, are formed on the tapered surface after the pressing step. Because of this, when the manufactured spark plug is mounted in the combustion device, it is possible to bring the helical protruding portion or annular protruding portions into comparatively high pressure contact with the bearing surface, and it is possible to reliably seal a space between the bearing surface and tapered surface over the whole circumference. As a result of this, it is possible to ensure superior airtightness.

Furthermore, even when some marks or irregularities are formed on the tapered surface before the tapered surface is pressed against the receiving surface, it is possible, by the tapered surface changing in shape by being pressed against the receiving surface, to form the helical protruding portion or annular protruding portions on the tapered surface while reducing the marks or irregularities to an extremely small size. That is, some marks or irregularities may be formed on the tapered surface before the pressing step, and it is not necessary to manage the tapered surface with particular caution. Also, as the arithmetic mean roughness of the surface of the tapered surface is set to 1 μm or more, the arithmetic mean roughness of the surface of the tapered surface also becomes 1 μm or more after the pressing step, and not much difference occurs in the condition of the tapered surface even though some minute marks are formed on the tapered surface in this condition. Consequently, it is not necessary to carry out the management of the tapered surface with particular caution after the pressing step either. Consequently, according to the configuration 5, it is easy to manage the tapered surface before and after the pressing step, and it is possible to further improve productivity.

In order to more reliably realize superior airtightness, it is preferable that the arithmetic mean roughness of the surface of a part of the receiving surface against which is pressed the tapered surface is set to 5 μm or less.

Configuration 6. In this configuration, the spark plug manufacturing method according to the configuration 5 is such that in the spark plug, the insulator and metal shell are fixed by a crimped portion, bent radially inward, which is provided in a rear end portion of the metal shell, and in the pressing step, by pressing the rear end portion of the metal shell, the rear end portion of the metal shell is bent radially inward to form the crimped portion, and the tapered surface is pressed against the receiving surface to form the annular protruding portions or helical protruding portion.

According to the configuration 6, it is possible to simultaneously form the crimped portion for fixing the metal shell and insulator and the helical protruding portion or annular protruding portions. Consequently, it is not necessary to provide the step of forming the crimped portion and the step of forming the helical protruding portion or annular protruding portions separately from one another, and it is possible to further improve productivity.

Configuration 7. In this configuration, the spark plug manufacturing method according to the configuration 5 is such that the size of the thread portion is M14 or less.

When the size of the thread portion is set to M14 or less, as in the configuration 7, the surface pressure of the tapered surface on the receiving surface is high, and a friction force generated between the receiving surface and tapered surface is small, when in the pressing step. Consequently, there is concern about a bite of the metal shell into the receiving die, but this kind of concern can be dispelled by employing the configuration 5 or the like. In other words, the configuration 5 or the like is particularly significant when manufacturing the spark plug with the size of the thread portion set to M14 or less.

Also, the manufactured spark plug is such that the configuration of the tapered surface satisfies the configuration 1 or the like. Because of this, it is possible to realize superior airtightness even when it is not possible to sufficiently ensure the area of the tapered surface in contact with the bearing surface by the size of thread being set to M14 or less.

Configuration 8. In this configuration, the spark plug manufacturing method according to the configuration 5 is such that the size of the thread portion is M12 or less.

When the size of the thread portion is set to M12 or less, as in the configuration 8, the surface pressure of the tapered surface on the receiving surface is very high, and a friction force generated between the receiving surface and tapered surface is extremely small, when in the pressing step. Consequently, there is more concern about a bite of the metal shell into the receiving die, but this kind of concern can be dispelled by employing the configuration 5 or the like. In other words, the configuration 5 or the like is extremely significant when manufacturing the spark plug with the size of the thread portion set to M12 or less.

In addition, the manufactured spark plug is such that the configuration of the tapered surface satisfies the configuration 1 or the like. Because of this, it is possible to realize superior airtightness even when the area of the tapered surface in contact with the bearing surface is very small by the size of thread being set to M12 or less.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
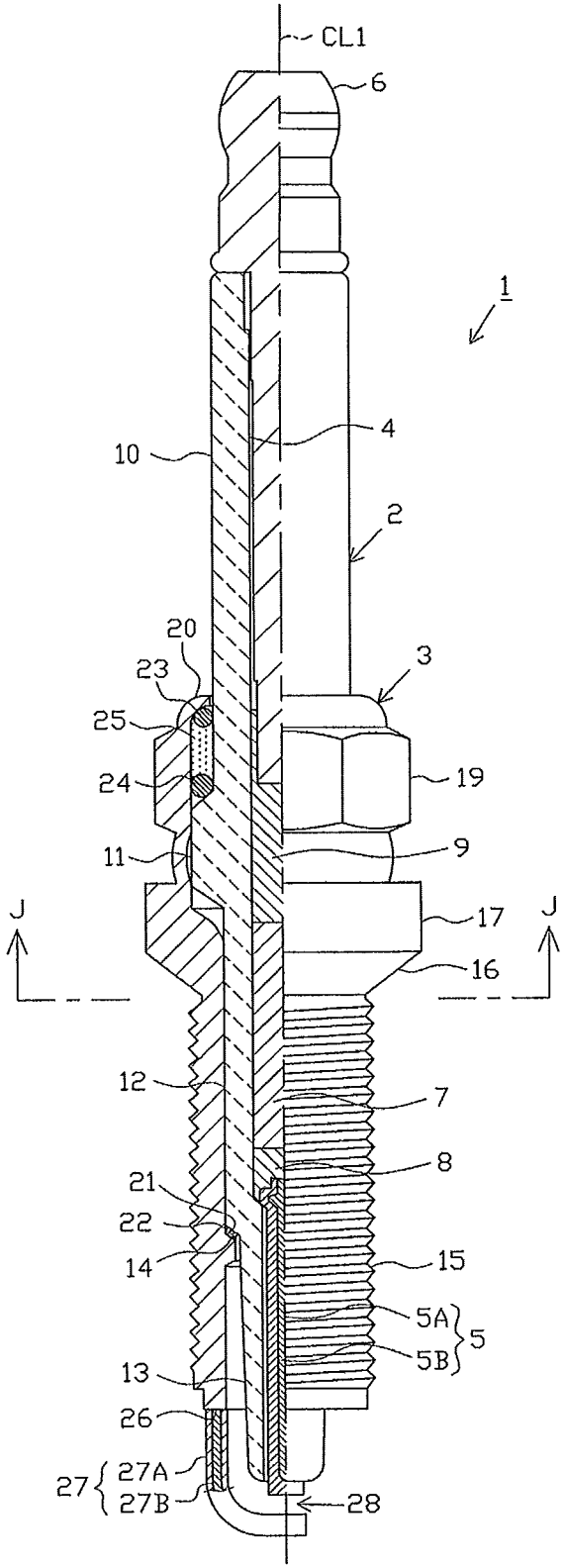
FIG. 1 is a partially sectioned front view showing a configuration of a spark plug.

Hereafter, a description will be given, referring to the drawings, of one embodiment. FIG. 1 is a partially sectioned front view showing a spark plug 1. In FIG. 1, a description will be given with a direction of an axis CL1 of the spark plug 1 as an up-down direction in the drawing, the lower side as a leading end side of the spark plug 1, and the upper side as a rear end side.

The spark plug 1 is configured of an insulator 2 acting as an insulator forming a hollow cylindrical shape, a hollow cylindrical metal shell 3 which holds the insulator 2, and the like.

The insulator 2, being formed by firing alumina or the like, as is well known, includes in the external portion thereof a rear end side barrel portion 10 formed on the rear end side, a large diameter portion 11 formed closer to the leading end side than the rear end side barrel portion 10 so as to protrude radially outward, a middle barrel portion 12 formed closer to the leading end side than the large diameter portion 11 so as to be smaller in diameter than the large diameter portion 11, and an insulator nose length portion 13 formed closer to the leading end side than the middle barrel portion 12 so as to be smaller in diameter than the middle barrel portion 12. In addition, the large diameter portion 11, the middle barrel portion 12, and the large proportion of the insulator nose length portion 13, of the insulator 2, are housed inside the metal shell 3. Also, a tapered shoulder portion 14 is formed at the connecting portion of the middle barrel portion 12 and insulator nose length portion 13, and the insulator 2 is retained on the metal shell 3 by the shoulder portion 14.

Furthermore, an axial hole 4 is formed in the insulator 2 along the axis CL1 so as to pass through the insulator 2, and a center electrode 5 is inserted and fixed in a leading end side portion of the axial hole 4. The center electrode 5 includes an inner layer 5A made of a metal superior in thermal conductivity [for example, copper, a copper alloy, or pure nickel (Ni)] and an outer layer 5B made of an Ni-based alloy as a main component. Also, the center electrode 5 forms a rod shape (a column shape) as a whole, and the leading end face thereof, as well as being formed so as to be flat, protrudes from the leading end of the insulator 2.

In addition, a terminal electrode 6 is inserted and fixed in a rear end side portion of the axial hole 4 with a portion of the terminal electrode 6 protruding from the rear end of the insulator 2.

Furthermore, a column-shaped resistor 7 is disposed between the center electrode 5 and terminal electrode 6 in the axial hole 4. The two end portions of the resistor 7 are electrically connected one each to the center electrode 5 and terminal electrode 6 via respective conductive glass seal layers 8 and 9.

In addition, the metal shell 3 is formed in a hollow cylindrical shape from a metal such as a low carbon steel, and a thread portion (an external thread portion) 15 for mounting the spark plug 1 in a combustion device (for example, an internal combustion engine or a fuel cell reformer) is formed on the outer peripheral surface of the metal shell 3. Also, a flanged seat portion 17 having a tapered surface 16 whose outer diameter decreases gradually toward the leading end side is formed closer to the rear end side than the thread portion 15. Furthermore, a tool engagement portion 19 of hexagonal cross section with which to bring a tool such as a wrench into engagement when mounting the metal shell 3 in the combustion device is provided in a rear end side portion of the metal shell 3. Also, a crimped portion 20 which bends radially inward is provided at the rear end portion of the metal shell 3.

In the embodiment, a reduction in diameter of the metal shell 3 is ensured in order to ensure a reduction in diameter of the spark plug 1, and the size of the thread portion 15 is set to M14 or less or M12 or less. Also, in order to improve durability, a plated layer made of a nickel or zinc-based metal as a main component and a trivalent chromate layer, provided on the plated layer, 95% mass or more of a chromium component contained in which is trivalent chromium, are formed on the surface of the metal shell 3. Furthermore, in order to further improve durability, the trivalent chromate layer is coated with anti-rust oil.

Also, a tapered shoulder portion 21 on which to retain the insulator 2 is provided on the inner peripheral surface of the metal shell 3. Further, the insulator 2 is inserted into the metal shell 3 from the rear end side toward the leading end side of the metal shell 3, and is fixed in the metal shell 3 by crimping a rear end side opening portion of the metal shell 3 radially inward, that is, forming the crimped portion 20, with the shoulder portion 14 of the insulator 2 retained on the shoulder portion 21 of the metal shell 3. An annular plate packing 22 is interposed between the shoulder portions 14 and 21. This maintains airtightness in a combustion chamber, thus preventing a fuel gas infiltrating into a space between the insulator 2 nose length portion 13 and metal shell 3 inner peripheral surface exposed in the combustion chamber from leaking to the exterior.

Furthermore, in order to make a crimping seal more complete, annular ring members 23 and 24 are interposed between the metal shell 3 and insulator 2 in a rear end side portion of the metal shell 3, and a space between the ring members 23 and 24 is filled with talc 25 powder. That is, the metal shell 3 holds the insulator 2 via the plate packing 22, ring members 23 and 24, and talc 25.

Also, a ground electrode 27, which is bent back approximately in the middle and whose leading end side side surface faces the leading end face of the center electrode 5, is joined to a leading end portion 26 of the metal shell 3. The ground electrode 27 is formed in a two-layer structure with an outer layer 27A made of an Ni alloy and an inner layer 27B made of a copper alloy or pure copper which is a metal with pyroconductivity better than that of the Ni alloy. Also, a spark discharge gap 28 is formed between the leading end portion of the center electrode 5 and the leading end portion of the ground electrode 27, and the spark discharge gap 28 is such that a spark discharge is carried out in a direction substantially along the axis CL1.

Figure 2:
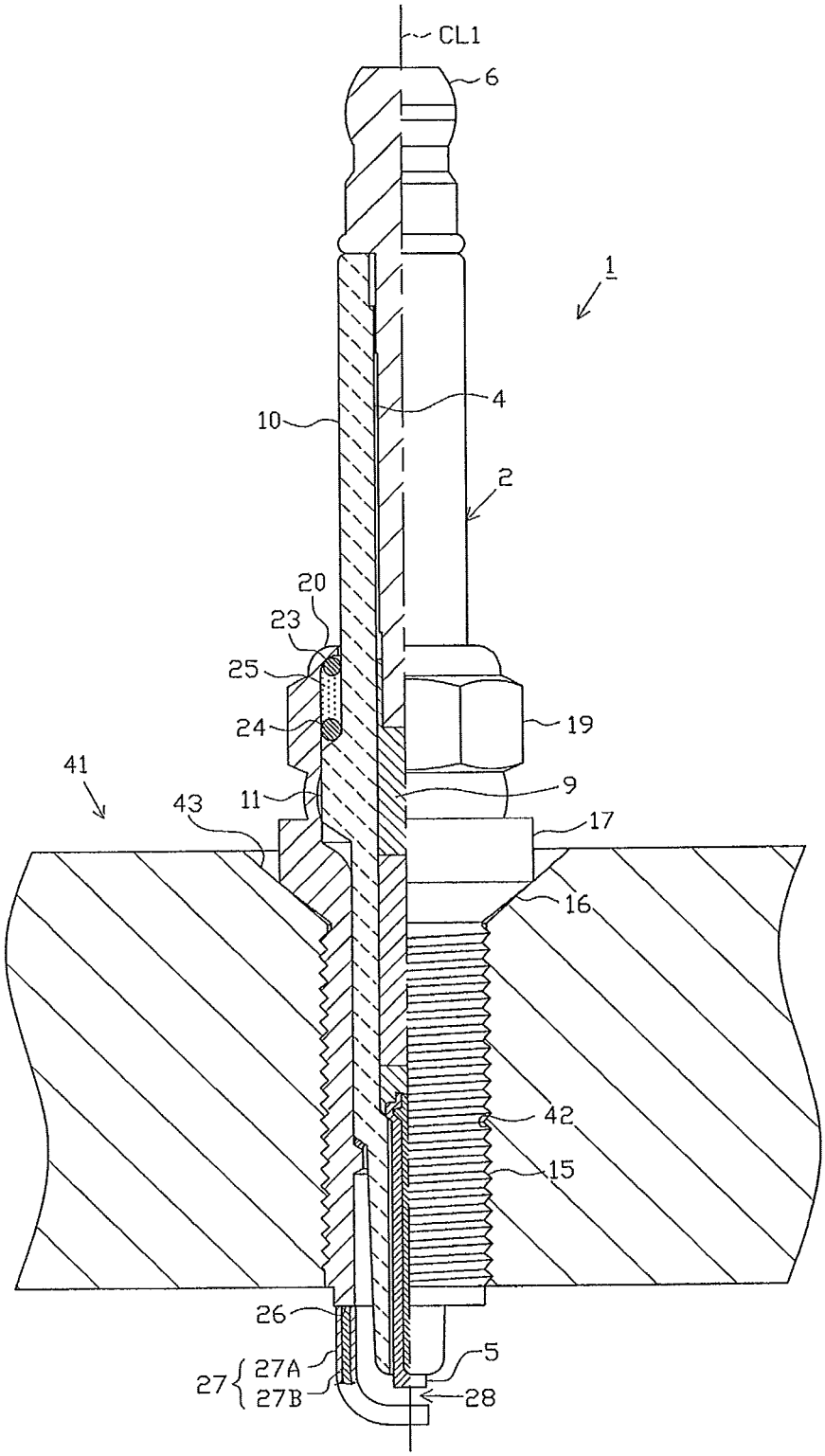
FIG. 2 is a partially sectioned front view showing the spark plug mounted in an internal combustion engine.

Furthermore, in the embodiment, when the thread portion 15 is threadedly engaged with an internally threaded mounting hole 42 formed in an internal combustion engine 41 acting as the combustion device, as shown in FIG. 2, the tapered surface 16 comes into close contact with a bearing surface 43 of the internal combustion engine 41, thereby maintaining airtightness in the combustion chamber. On a section including the axis CL1, an acute angle (an inclination angle) of angles formed by the visible outline of the bearing surface 43 and the axis CL1 is smaller than an acute angle (an inclination angle) of angles formed by the visible outline of the tapered surface 16 and the axis CL1. Consequently, when the thread portion 15 is threadedly engaged with the mounting hole 42, a part of the tapered surface 16 positioned on the outer periphery side comes into contact with the bearing surface 43. The inclination angle of the bearing surface 43 is set to, for example, 60°, and the inclination angle of the tapered surface 16 is set to, for example, 63°.

Figure 3:
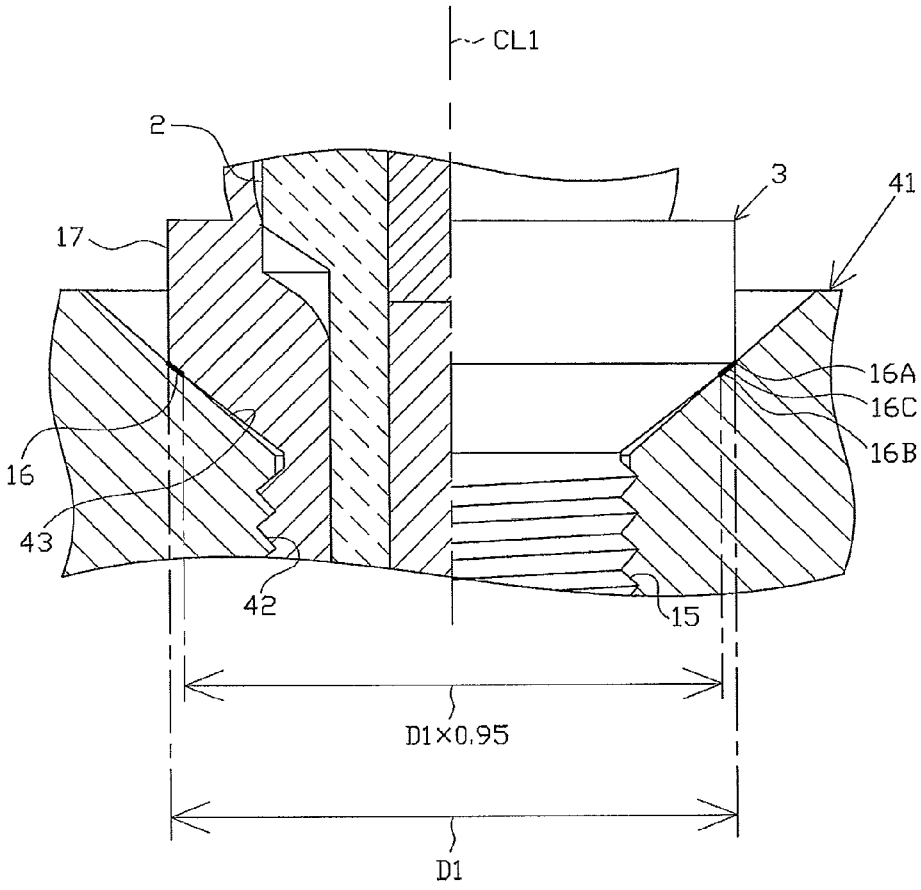
FIG. 3 is a partially sectioned enlarged front view showing the spark plug mounted in the internal combustion engine.

Also, the bearing surface 43 is formed from an aluminium-based comparatively soft (for example, approximately 100 Hv) alloy, while the hardness of the tapered surface 16 (seat portion 17) is set to be higher than the hardness of the bearing surface 43. Because of this, when the thread portion 15 is threadedly engaged with the mounting hole 42, the bearing surface 43 changes in shape by being pressed against the tapered surface 16, and an outer periphery side of the tapered surface 16 comes into surface contact with the bearing surface 43. Specifically, when a change in shape of the bearing surface 43 is small, for example, when the spark plug 1 is mounted in the internal combustion engine 41 for the first time, an outer periphery side region 16C (a part shown by the heavy line in FIG. 3) of the tapered surface 16, from an outermost peripheral portion 16A to a part 16B forming an outer diameter occupying 95% of an outer diameter D1 of the outermost peripheral portion 16A, comes into surface contact with the bearing surface 43, as shown in FIG. 3, while a part closer to the inner periphery side than the outer periphery side region 16C does not necessarily come into contact with the bearing surface 43. That is, the outer periphery side region 16C is a particularly important part in terms of maintaining airtightness in the combustion chamber. By repeatedly carrying out a mounting and dismounting of the spark plug 1 in and from the internal combustion engine 41, the bearing surface 43 can gradually change to a shape following the shape of the tapered surface 16, and eventually, change in shape to the extent that the inner periphery side of the tapered surface 16 makes contact with the bearing surface 43.

Figure 4A:
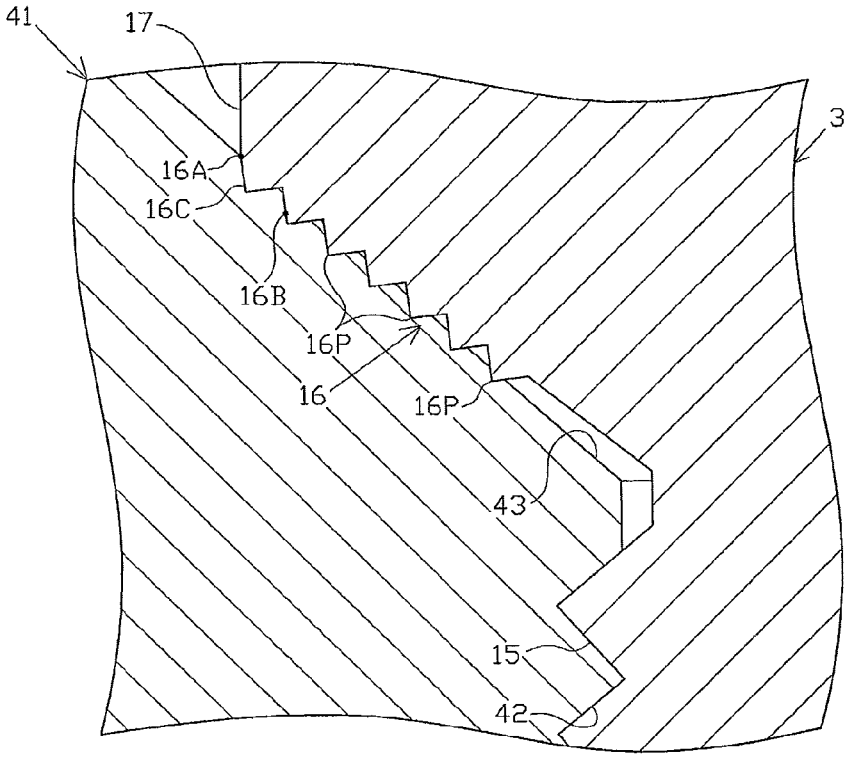
FIG. 4A is an enlarged sectional schematic view showing a configuration of a tapered surface.
Figure 4B:
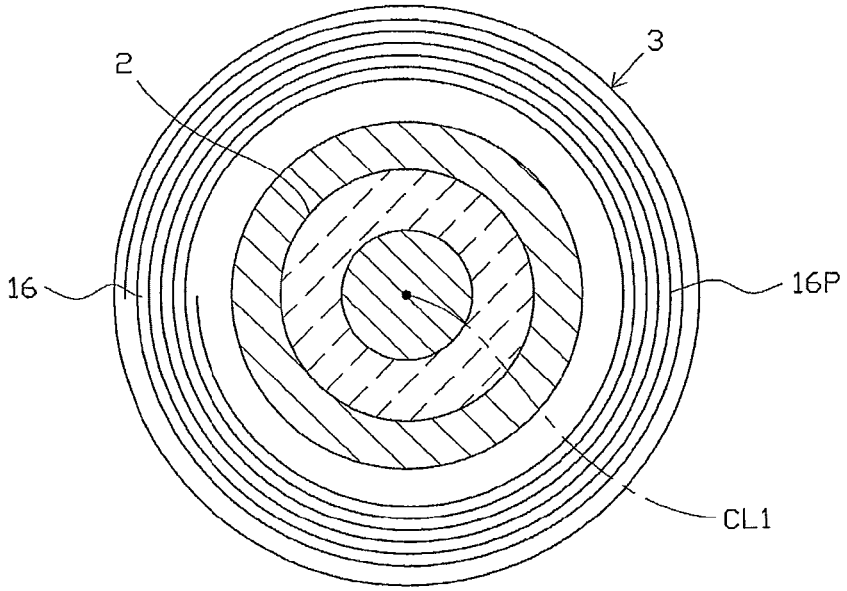
FIG. 4B is a sectional view taken along line J-J of FIG. 1.

Also, in the embodiment, a helical protruding portion 16P having the length of one or more turns, extending in a circumferential direction of the metal shell 3, is formed in the whole area of the tapered surface 16 including the outer periphery side region 16C, as shown in FIGS. 4A and 4B (FIGS. 4A and 4B show the protruding portion 16P more protruded than it actually is, and the number of turns thereof more reduced than it actually is, for simplification of illustration). In the embodiment, the protruding portion 16P is configured so as to protrude most on the tapered surface 16. Furthermore, an arithmetic mean roughness Ra of the surface of the tapered surface 16 is set to 1 μm or more and 5 μm or less on a section including the axis CL1. Herein, the arithmetic mean roughness Ra of the surface of the tapered surface 16 can be measured based on JIS B0601. Specifically, a sensing pin with the radius of the leading end set to 2 μm and the cone angle of the leading end set to 60° is caused to move radially outward from the axis CL1 side in a direction perpendicular to the axis CL1 at a predetermined measuring speed while being brought into contact with a surface to be measured (the tapered surface 16), thereby obtaining a contour curve indicating the height of each portion of the tapered surface 16 from a straight line perpendicular to the axis CL1. Further, it is possible to obtain the arithmetic mean roughness Ra of the surface of the tapered surface 16 by obtaining the integrated value of a difference in the contour curve to an average line of the contour curve in a range to be measured.

The whole area of the tapered surface 16 refers to the whole area of a part of the tapered surface 16 which can come into contact with the bearing surface 43, and in the embodiment, to a range on the tapered surface 16 from the outermost peripheral portion 16A to a part on the tapered surface 16 forming an outer diameter equal to the size of the thread portion 15.

Figure 5:
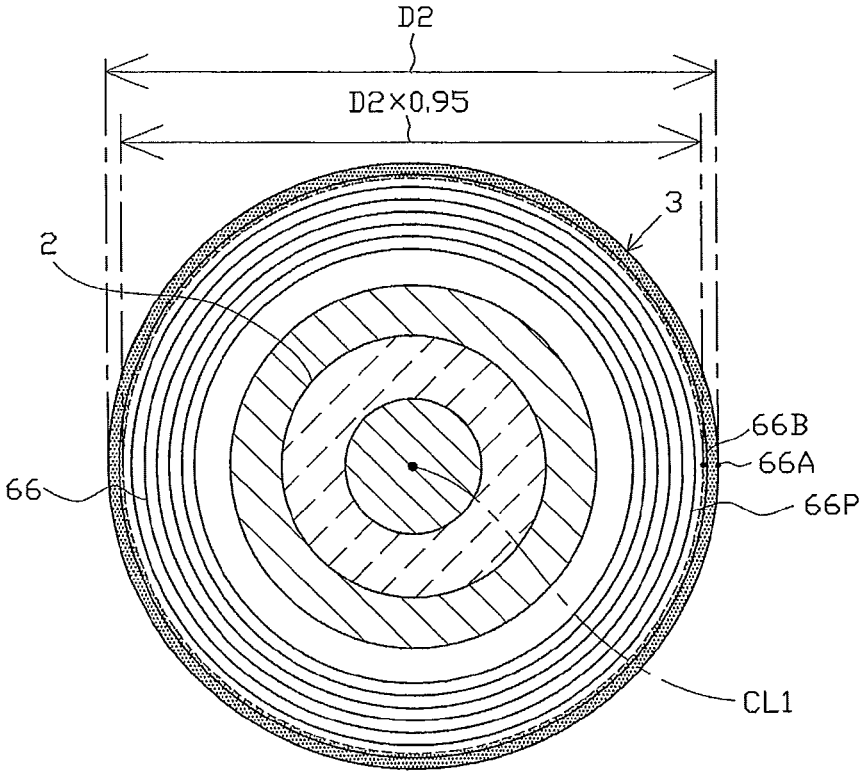
FIG. 5 is a sectional view of a metal shell, and the like, showing annular protruding portions.

Also, in place of the helical protruding portion 16P, a plurality of annular protruding portions 66P extending in a circumferential direction of the metal shell 3 may be provided on the tapered surface 66, as shown in FIG. 5. The annular protruding portions 66P are provided over the whole area of the tapered surface 66 in FIG. 5, but it is sufficient that the annular protruding portions 66P are provided within at least a range (in FIG. 5, a part patterned with scattered points) on the tapered surface 66 from an outermost peripheral portion 66A to a part 66B forming an outer diameter occupying 95% of an outer diameter D2 of the outermost peripheral portion. In addition, both the helical protruding portion and annular protruding portions may be provided on the tapered surface.

Next, a description will be given of a method of manufacturing the spark plug 1 configured in the way heretofore described.

Firstly, the insulator 2 is formed. A forming spray dried powder granulated substance is prepared using alumina-based raw powder containing a binder or the like, and a rubber press forming is carried out using the granulated substance, thereby obtaining a hollow cylindrical compact. Further, after the external form of the obtained compact has been pulled into shape by grinding the compact, the compact pulled into shape is fired, thereby obtaining the insulator 2.

Also, the center electrode 5 is manufactured, apart from the insulator 2. That is, an Ni alloy in the central portion of which is disposed a copper alloy or the like for improving heat dissipation is forged to fabricate the center electrode 5.

Further, the insulator 2 and center electrode 5 obtained in the way heretofore described, the resistor 7, and the terminal electrode 6 are sealed and fixed by the glass seal layers 8 and 9. As the glass seal layers 8 and 9, in general, a mixture of borosilicate glass and metal powder is prepared, and the prepared mixture, after having been injected into the axial hole 4 of the insulator 2 so as to sandwich the resistor 7, is sintered by being heated in a furnace while being pressed from the rear by the terminal electrode 6. At this time, a glaze layer may be simultaneously sintered, or a glaze layer may be formed in advance, on the surface of the rear end side barrel portion 10 of the insulator 2.

Next, the metal shell 3 is processed. That is, a column-shaped metal material (for example, an iron-based material or stainless material such as S17C or S25C) is, for example, cool forged, thereby forming a through hole, and forming an outline. Subsequently, the external form is pulled into shape by performing a cutting, thus obtaining a metal shell intermediate body.

Continuing, the straight rod-shaped ground electrode 27 made of an Ni alloy or the like is resistance welded to the leading end face of the metal shell intermediate body. As a so-called "sagging" occurs when resistance welding, the thread portion 15 is formed in a predetermined part of the metal shell intermediate body by a thread rolling after the "sagging" has been removed. By so doing, the metal shell 3 to which is joined the ground electrode 27 is obtained. Furthermore, a plated layer and a trivalent chromate layer are provided by plating the metal shell 3 with the ground electrode 27 welded thereto. Also, the surface of the metal shell 3 is coated with anti-rust oil.

The obtained metal shell 3 has no helical protruding portion 16P formed on the tapered surface 16 of the seat portion 17, and the tapered surface 16 is made flat. Some irregularities or marks may be formed on the tapered surface 16.

Subsequently, the insulator 2 including the center electrode 5 and terminal electrode 6 and the metal shell 3 including the ground electrode 27, each fabricated in the way heretofore described, are fixed in a pressing step.

Figure 6:
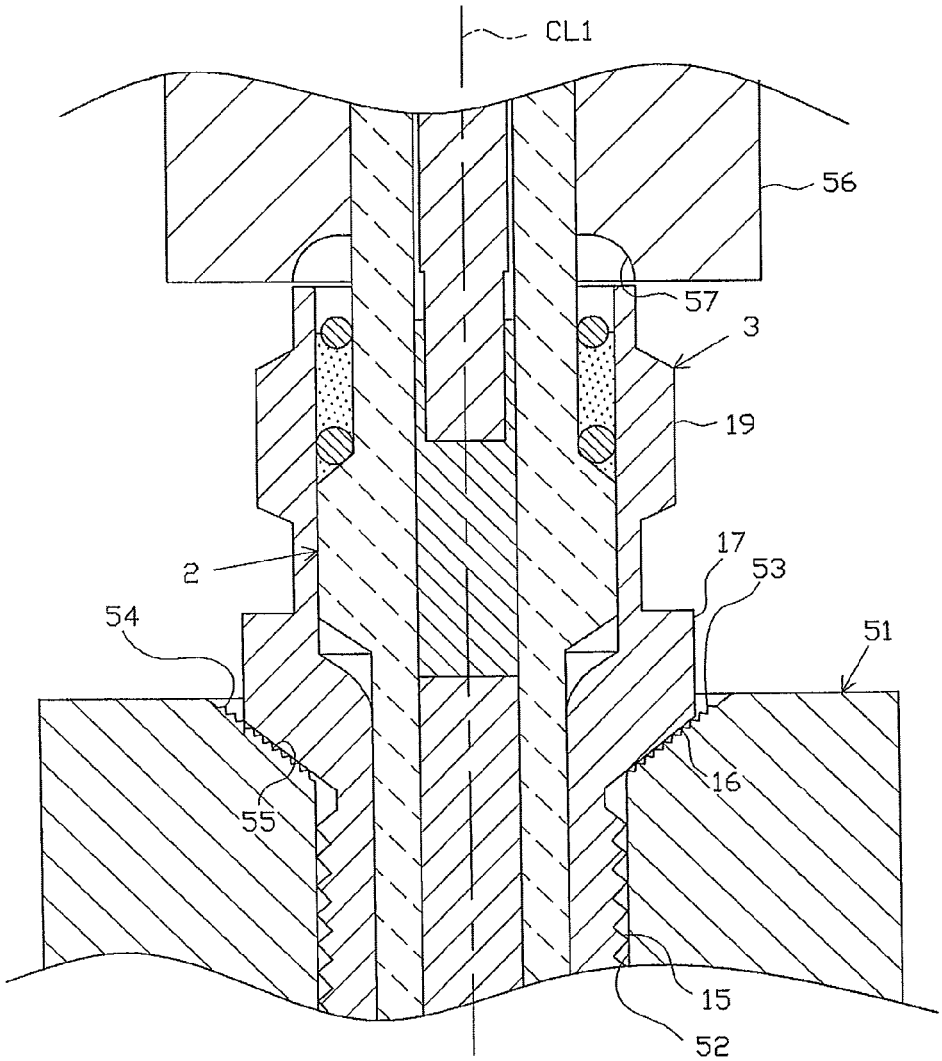
FIG. 6 is an enlarged sectional view of a receiving die, and the like, showing a condition in which the metal shell is set on a receiving die.
Figure 7:
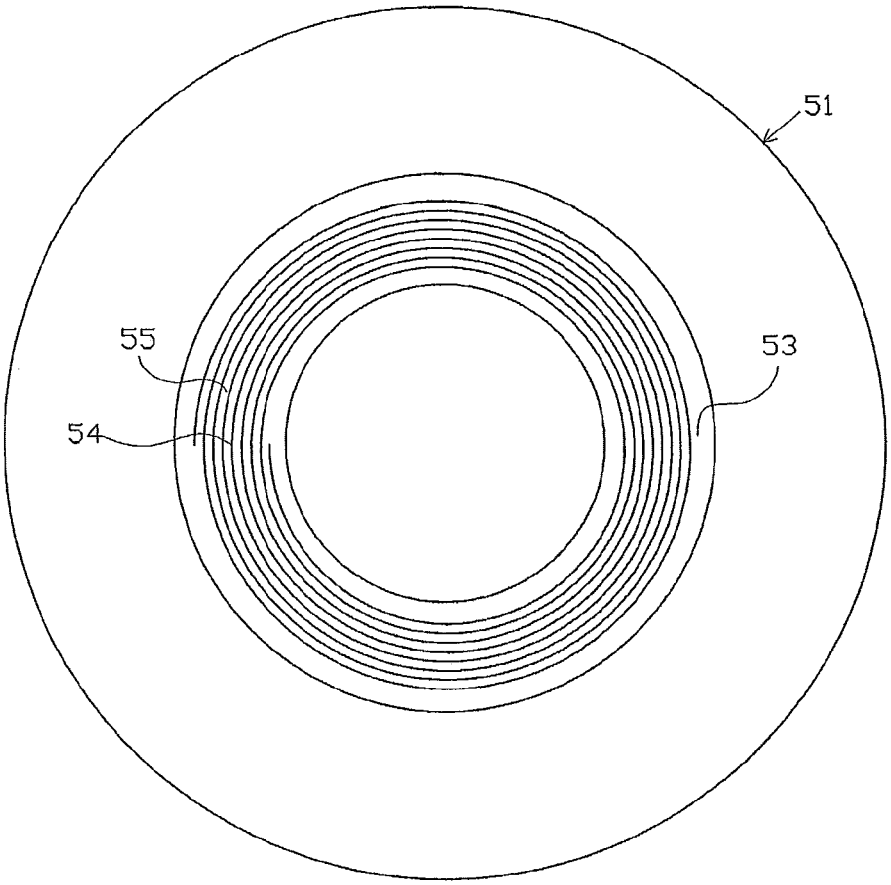
FIG. 7 is a plan view showing a configuration of the receiving die.

In the pressing step, firstly, the metal shell 3 is held by a hollow cylindrical receiving die 51 by inserting a leading end side portion of the metal shell 3 into the receiving die 51 with the insulator 2 inserted in the metal shell 3, as shown in FIG. 6.

The receiving die 51 includes an insertion hole 52, into which the thread portion 15 can be inserted, and an annular receiving surface 53, connecting with an opening of the insertion hole 52, with which the tapered surface 16 comes into contact. Also, the inclination angle of the receiving surface 53 is set so as to be the same (for example, 63°) as the inclination angle of the tapered surface 16. The receiving die 51 is formed from hard steel such as hardening steel, and at least the hardness of the receiving surface 53 is made higher than the hardness of the tapered surface 16 of the metal shell 3.

Furthermore, in the pressing step, the tapered surface 16 is pressed against the receiving surface 53. Further, at least one portion of a part of the receiving surface 53 against which the tapered surface 16 is pressed (in the embodiment, the whole area of the part against which the tapered surface 16 is pressed), being such that an arithmetic mean surface roughness Ra of the surface thereof is set to 1 μm or more and 5 μm or less, includes a helical protrusion portion 54 and depression portion 55 having the length of one or more turns, which extend in a circumferential direction of the receiving surface 53. The depression portion 55 refers to a helical groove-shaped portion formed between one turn and another of the protrusion portion 54.

The arithmetic mean roughness Ra of the surface of the receiving surface 53 can be measured based on JIS B0601. Specifically, a sensing pin with the radius of the leading end set to 2 μm and the cone angle of the leading end set to 60° is caused to move radially outward from the central axis side in a direction perpendicular to the central axis of the insertion hole 52 while being brought into contact with a surface to be measured (the receiving surface 53), thereby obtaining a contour curve indicating the height of each portion of the receiving surface 53 from a straight line perpendicular to the central axis. Further, it is possible to obtain the arithmetic mean roughness Ra of the surface of the receiving surface 53 by obtaining the integrated value of a difference in the contour curve to an average line of the contour curve in a range to be measured.

Figure 8:
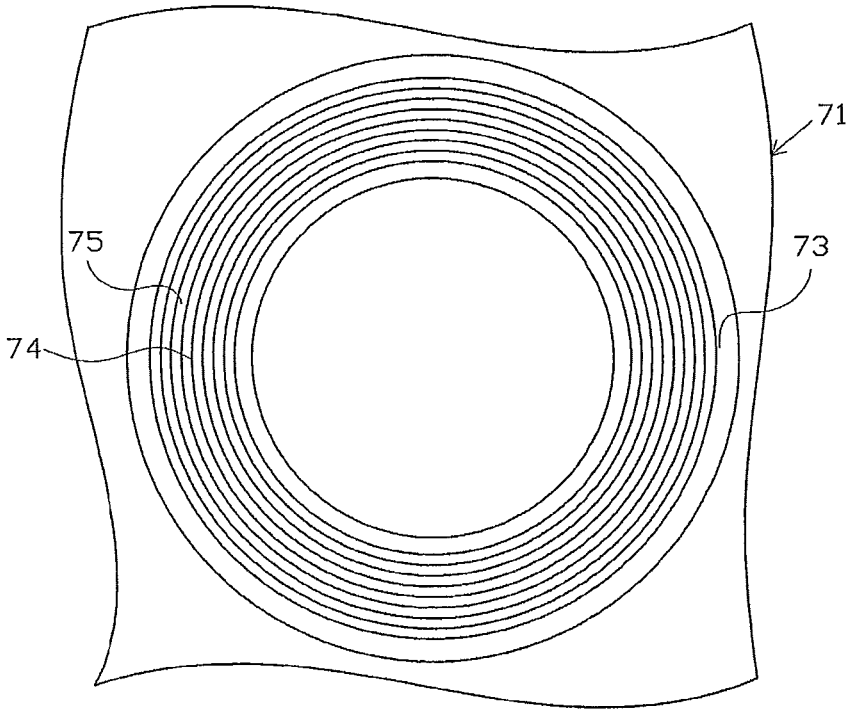
FIG. 8 is a plan view showing another example of the receiving die.

Also, in place of the helical protrusion portion 54 and depression portion 55, annular protrusion portions 74 and depression portions 75 (the depression portions 75 each refer to a groove-shaped portion provided between adjacent protrusion portions 74) extending in a circumferential direction of the receiving surface 73 may be provided on the receiving surface 73 of the receiving die 71, as shown in FIG. 8. The protrusion portions 74 and depression portions 75 are formed over the whole area of a part of the receiving surface 73 against which the tapered surface 16 is pressed, in FIG. 8, but it is sufficient that the protrusion portions 74 and depression portions 75 are provided in at least a part of the receiving surface 73 against which the outer periphery side region 16C of the tapered surface 16 is pressed.

Figure 9:
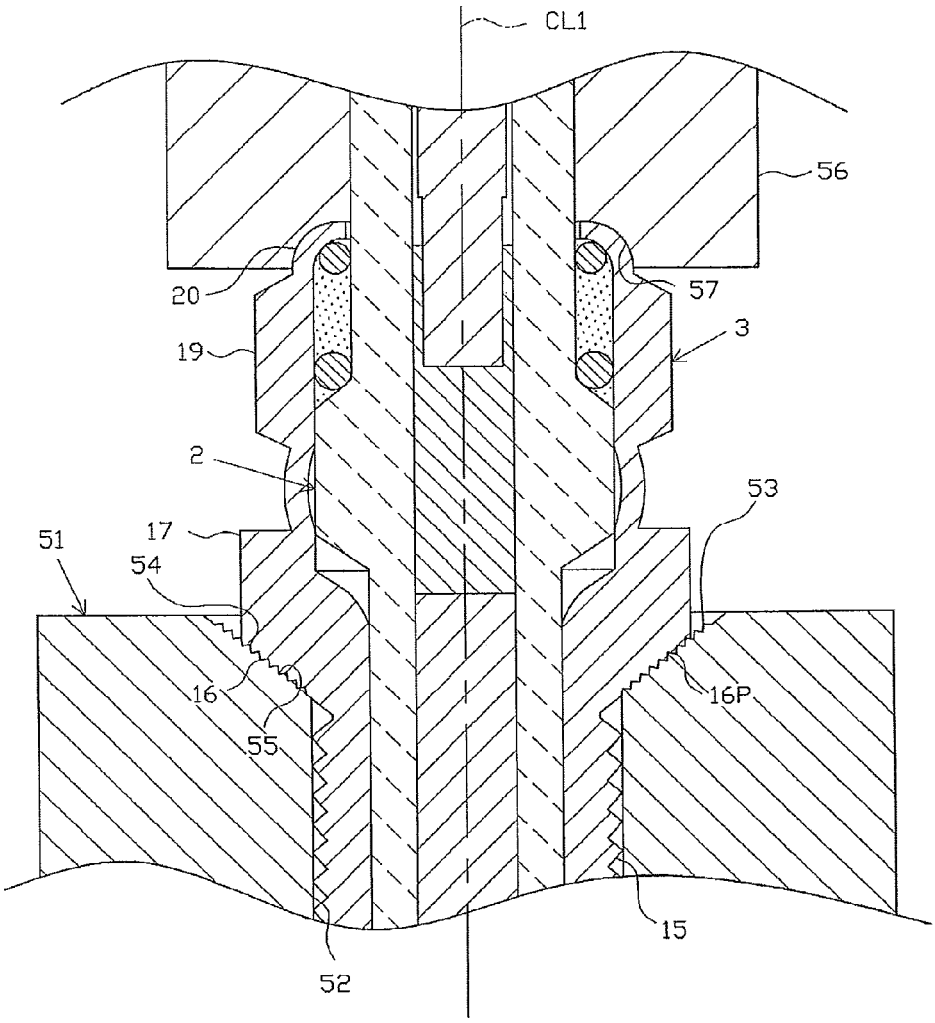
FIG. 9 is an enlarged sectional view showing one process of a pressing step.

Returning to the description of the manufacturing method, a hollow cylindrical pressing die 56 having, on an inner peripheral surface at the leading end of an opening portion thereof, a curved surface portion 57 whose shape corresponds to the shape of the crimped portion 20, is mounted from above the metal shell 3 with the metal shell 3 held by the receiving die 51, as shown in FIG. 6. After that, the metal shell 3 is pressed with a predetermined load (for example, 30 kN or more and 50 kN or less) toward the receiving die 51 side by the pressing die 56 with the metal shell 3 clamped by the receiving die 51 and pressing die 56. By so doing, the tapered surface 16 changes in shape by being pressed against the receiving surface 53, and the helical protruding portion 16P is formed on the surface of the tapered surface 16, as shown in FIG. 9. Also, even when some irregularities or marks are formed on the tapered surface 16, the tapered surface 16 changes in shape following the receiving surface 53 as a result of being pressed against the receiving surface 53, and the marks or irregularities on the surface become extremely smaller, thus causing the arithmetic mean roughness Ra of the surface of the tapered surface 16 to fall within 1 μm or more and 5 μm or less. In addition, the crimped portion 20 is formed by the rear end side opening of the metal shell 3 being bent radially inward, and the insulator 2 and metal shell 3 are fixed. That is, in the embodiment, the protruding portion 16P and crimped portion 20 are simultaneously formed.

A comparatively thin-walled cylindrical part positioned between the seat portion 17 and tool engagement portion 19 changes in shape so as to curve radially outward by applying a load from the pressing die 56. Because of this, an axial force along the axis CL1 is applied to the insulator 2 from the metal shell 3, as a result of which the insulator 2 and metal shell 3 are more firmly fixed.

After fixing the metal shell 3 and insulator 2, the ground electrode 27 is bent toward the center electrode 5 side, and the size of the spark discharge gap 28 formed between the leading end portion of the center electrode 5 and the leading end portion of the ground electrode 27 is adjusted, thereby obtaining the heretofore described spark plug 1.

As heretofore described in detail, according to the embodiment, the arithmetic mean roughness Ra of a surface of the tapered surface 16 including the outer periphery side region 16C is set to 1 μm or more on the section including the axis CL1, thus allowing the existence of some irregularities. Consequently, not much difference occurs in the condition of the tapered surface 16 even though minute marks are formed on the tapered surface 16, and it is not necessary to carry out the management of the tapered surface 16 with particular caution during a manufacturing process, conveyance, or the like. As a result of this, it is possible to realize superior productivity and manageability.

In addition, in the embodiment, the helical protruding portion 16P with one or more turns, or the annular protruding portions 66P, extending in the circumferential direction of the metal shell 3, are formed on the tapered surface 16. Consequently, when the spark plug 1 is mounted in the internal combustion engine 41, it is possible to bring particularly the helical protruding portion 16P or annular protruding portions 66P of the tapered surface 16 into comparatively high pressure contact with the bearing surface 43. Furthermore, as the protruding portion 16P or protruding portions 66P in comparatively high pressure contact form a helical shape with one or more turns or an annular shape respectively, it is possible to more reliably seal a space between the bearing surface 43 and tapered surface 16 over the whole circumference. As a result of this, it is possible to ensure superior airthightness.

Furthermore, in the embodiment, the arithmetic mean roughness of the surface of the tapered surface 16 is set to 5 μm or less. Consequently, it is possible to sufficiently ensure the close contact of the tapered surface 16 with the bearing surface 43, and it is possible to more reliably realize superior airtightness.

Also, in the embodiment, the helical protruding portion 16P or annular protruding portions 66P are formed in the whole area of the tapered surface 16. Because of this, it is possible to bring the helical protruding portion 16P or annular protruding portions 66P formed in any position into contact with the bearing surface 43 even when a deformation occurs on the bearing surface 43 by repeatedly carrying out a mounting and dismounting of the spark plug 1 in and from the internal combustion engine 41. Consequently, it is possible to maintain good airtightness even when a deformation occurs on the bearing surface 43 by carrying out a plurality of times of mounting of the spark plug 1.

Furthermore, at least one portion of a part of the receiving surface 53 of the receiving die 51 against which is pressed the tapered surface 16 is such that the arithmetic mean roughness of the surface thereof is set to 1 μm or more when manufacturing the spark plug 1. Consequently, it is possible to sufficiently increase a friction force generated between the receiving surface 53 and tapered surface 16, and it is possible to suppress slippage of the tapered surface 16 on the receiving surface 53 when pressing the metal shell 3. As a result of this, it is possible to prevent the metal shell 3 from biting into the receiving die 51, and it is possible to improve productivity and yield. Particularly in the embodiment, as the pressing step is carried out after the surface of the metal shell 3 has been coated with anti-rust oil, the tapered surface 16 is more liable to slip on the receiving surface 53 in the pressing step, but it is possible to sufficiently suppress slippage of the tapered surface 16 on the receiving surface 53 even in this kind of condition.

Also, at least one portion of a part of the receiving surface 53 against which the tapered surface 16 is pressed includes the helical protrusion portion 54 and depression portion 55 having the length of one or more turns, or the annular protrusion portions 74 and depression portions 75, extending in the circumferential direction of the receiving surface 53. Consequently, the helical protruding portion 16P having the length of one or more turns, or the annular protruding portions 66P, extending in the circumferential direction of the metal shell 3, are formed on the tapered surface 16 after the pressing step. Because of this, when the manufactured spark plug 1 is mounted in the internal combustion engine 41, it is possible to bring the helical protruding portion 16P or annular protruding portions 66P into comparatively high pressure contact with the bearing surface 43, and it is possible to reliably seal a space between the bearing surface 43 and tapered surface 16 over the whole circumference. As a result of this, it is possible to ensure superior airtightness.

Furthermore, even when some marks or irregularities are formed on the tapered surface 16 before the tapered surface 16 is pressed against the receiving surface 53, it is possible, by the tapered surface 16 changing in shape by being pressed against the receiving surface 53, to form the helical protruding portion 16P or annular protruding portions 66P on the tapered surface 16 while reducing the marks or irregularities to an extremely small size. That is, some marks or irregularities may be formed on the tapered surface 16 before the pressing step, and it is not necessary to manage the tapered surface 16 with particular caution. Also, as the arithmetic mean roughness of the surface of the tapered surface 16 is set to 1 μm or more after the pressing step, not much difference occurs in the condition of the tapered surface 16 even though minute marks are formed on the tapered surface 16. Consequently, it is not necessary to carry out the management of the tapered surface 16 with particular caution after the pressing step either. That is, according to the embodiment, it is easy to manage the tapered surface 16 before and after the pressing step, and it is possible to further improve productivity.

In addition, in the embodiment, it is possible to simultaneously form the crimped portion 20 for fixing the metal shell 3 and insulator 2 and the helical protruding portion 16P or annular protruding portions 66P. Consequently, it is not necessary to provide the step of forming the crimped portion 20 and the step of forming the helical protruding portion 16P or annular protruding portions 66P separately from one another, and it is possible to further improve productivity.

Also, as at least one portion of a part of the receiving surface 53 on the receiving die 51 against which is pressed the tapered surface 16 is such that the arithmetic mean roughness of the surface thereof is set to 5 μm or less, it is possible, with the manufactured spark plug 1, to sufficiently ensure the close contact of the tapered surface 16 with the bearing surface 43. Because of this, it is possible to more reliably realize superior airtightness.

Figure 10:
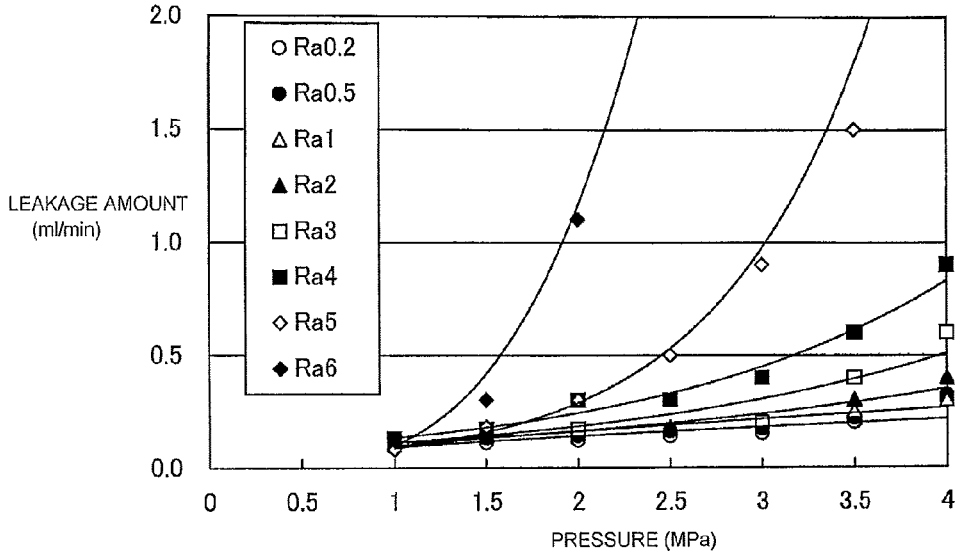
FIG. 10 is a graph showing results of an airtightness evaluation test on samples wherein the arithmetic mean roughness of a surface in an outer periphery side region is variously changed.

Next, in order to confirm working effects exerted by the heretofore described embodiment, spark plug samples wherein the helical protruding portion having the length of one or more turns is provided in the outer periphery side region of the tapered surface, and the arithmetic mean roughness Ra in the outer periphery side region is variously changed, are fabricated, and an airtightness evaluation test is carried out on each sample. The airtightness evaluation test is based on the airtight test of ISO11565, and the outline is as follows. That is, each sample is mounted in an aluminium test bed modeled after the internal combustion engine with a tightening torque of 20N·m, and the bearing surface of the test bed is heated to 200° C. In this condition, an air pressure of 1 MPa to 4 MPa continues to be applied to the leading end of each sample, and an air leakage amount per minute (ml/min) from between each sample (the tapered surface) and the test bed (bearing surface) is measured. FIG. 10 shows a graph representing a relationship between the air pressure and leakage amount in each sample. In FIG. 10, test results of samples with the arithmetic mean roughness Ra in the outer periphery side region set to 0.2 μm are shown by the outlined circle, test results of samples with the arithmetic mean roughness Ra set to 0.5 μm are shown by the black circle, test results of samples with the arithmetic mean roughness Ra set to 1 μm are shown by the outlined triangle, and test results of samples with the arithmetic mean roughness Ra set to 2 μm are shown by the black triangle. Also, test results of samples with the arithmetic mean roughness Ra set to 3 μm are shown by the outlined square, test results of samples with the arithmetic mean roughness Ra set to 4 μm are shown by the black square, test results of samples with the arithmetic mean roughness Ra set to 5 μm are shown by the outlined rhombus, and test results of samples with the arithmetic mean roughness Ra set to 6 μm are shown by the black rhombus.

Furthermore, Table 1 shows an airtightness evaluation of each sample when the air pressure is set to 2 MPa or 3 MPa. In Table 1, when the pressure is set to 2 MPa, samples with a leakage amount of more than 0.5 ml/min and 1.0 ml/min or less are given a "○" evaluation as having good airtightness, and samples with a leakage amount of 0.5 ml/min or less are given a "◎" evaluation as having superior airtightness. Also, when the pressure is set to 3 MPa, samples with a leakage amount of 1.0 ml/min or less are given a "◎" evaluation as having superior airtightness, and samples with a leakage amount of 0.5 ml/min or less are given a "✧" evaluation as having extremely superior airtightness. In the airtightness test based on ISO11565, when the leakage amount is 2.0 ml/min or less after the pressure has been set to 2.0 MPa, there is deemed to be no problem in terms of airtightness. Consequently, in this test, each sample is evaluated by standards more strict than the standards of ISO.

In each sample, the size of the thread portion is set to M14, and the opposite side dimension of the tool engagement portion is set to 16 mm. Furthermore, a plated layer made of an Ni-based metal and a trivalent chromate layer are provided on the surface of the metal shell, and the surface of the trivalent chromate layer is coated with anti-rust oil. Furthermore, the arithmetic mean roughness Ra is measured using a JIS type contact surface roughness tester, and a sensing pin coming into contact with a portion to be measured is such that the radius of the leading end is set to 2 μm, the cone angle of the leading end is set to 60°, and the measuring speed is set to 0.03 mm/s. In addition, the arithmetic mean roughness in the outer periphery side region of each sample is changed by changing the arithmetic mean roughness of the receiving surface of the receiving die. Also, the inclination angle of the bearing surface of the test bed is set to 60°, and the inclination angle of the tapered surface of each sample is set to 63° (the configuration of the metal shell and the method of measuring the arithmetic mean roughness are the same in the following tests too).

TABLE 1

| | | Arithmetic mean roughness Ra (μm) | | | | | | | |
|---|---|---|---|---|---|---|---|---|---|
| | | 0.2 | 0.5 | 1 | 2 | 3 | 4 | 5 | 6 |
| Pressure (MPa) | 2 | ◎ | ◎ | ◎ | ◎ | ◎ | ◎ | ◎ | X |
| | 3 | ✧ | ✧ | ✧ | ✧ | ✧ | ✧ | ◎ | X |

As shown in Table 1 and FIG. 10, it has been confirmed that the samples with the arithmetic mean roughness Ra in the outer periphery side region set to 5 μm or less have superior airtightness. It is conceivable that this is because when each of the samples is mounted in the test bed, the helical protruding portion comes into comparatively high pressure contact with the bearing surface, and a space between the bearing surface and tapered surface is sealed over the whole circumference.

Also, in particular, it has been found that the samples with the arithmetic mean roughness Ra set to 4 μm or less have extremely superior airtightness.

Next, spark plug samples (with protruding portion) wherein the helical protruding portion is provided in the outer periphery side region of the tapered surface, and the arithmetic mean roughness Ra in the outer periphery side region is variously changed, and spark plug samples (with no protruding portion) wherein no helical protruding portion is provided in the outer periphery side region of the tapered surface, and the arithmetic mean roughness Ra in the outer periphery side region is variously changed by roughening the outer periphery side region, are fabricated, and the heretofore described airtightness evaluation test is carried out after the air pressure has been set to 2 MPa. Table 2 shows an air leakage amount of each sample. In FIG. 2, "heavy leakage" means that the air leakage amount is more than 4 ml/min.

TABLE 2

| | Leakage amount (ml/min) | | | | | | | |
|---|---|---|---|---|---|---|---|---|
| | Ra 0.2 | Ra 0.5 | Ra 1 | Ra 2 | Ra 3 | Ra 4 | Ra 5 | Ra 6 |
| With protruding portion | 0.12 | 0.14 | 0.15 | 0.16 | 0.17 | 0.3 | 0.3 | 1.1 |
| With no protruding portion | 0.11 | 0.25 | 0.9 | 2 | 4 | Heavy leakage | Heavy leakage | Heavy leakage |

As shown in Table 2, it has been confirmed that when the arithmetic mean roughness Ra is set to less than 1 μm, the leakage amount is sufficiently small regardless of whether there is a helical protruding portion, and it is possible to ensure good airtightness, but that when the arithmetic mean roughness Ra is set to 1 μm or more, airtightness deteriorates rapidly in the samples provided with no helical protruding portion, while it is possible, with the samples each provided with the helical protruding portion, to maintain good airtightness. It is conceivable that this results from the fact that a space between the tapered surface and bearing surface is sealed over the whole circumference by providing the helical protruding portion.

It may be said from the heretofore described test results that although the outer periphery side region of the tapered surface is made comparatively rough by setting the arithmetic mean roughness Ra in the outer periphery side region to 1 μm or more, it is preferable, in terms of ensuring good airtightness, that the arithmetic mean roughness Ra in the outer periphery side region is set to 5 μm or less, and that the helical protruding portion having the length of one or more turns is provided in the outer periphery side region.

Also, it may be said that it is preferable, from the standpoint of further improving airtightness, to set the arithmetic mean roughness Ra in the outer periphery side region to 4 μm or less.

When the annular protruding portions extending in the circumferential direction of the metal shell are provided on the tapered surface too, it is possible to seal a space between the tapered surface and bearing surface over the whole circumference. Consequently, it may be said that it is also possible to realize good airtightness when the annular protruding portions are provided, in the same way as when the helical protruding portion is provided.

Next, spark plug samples (samples A) wherein the helical protruding portion is provided only in the outer periphery side region of the tapered surface, and spark plug samples (samples B) wherein the helical protruding portion is provided over the whole area of the tapered surface, are fabricated. Further, after the number of times of mounting each sample in the test bed has been changed from one to 100, 200, 300, or 400, the heretofore described airtightness evaluation test is carried out with the air pressure set to 2 MPa. Table 3 shows results of the test. One time of mounting refers to a condition in which a sample is mounted in the test bed for the first time. Also, a plurality of times of mounting refers to a condition in which a mounting and dismounting of a sample in and from the test bed is repeatedly carried out, and the sample has been mounted in the test bed for the pluralth (for example, 100th or 200th) time.

TABLE 3

| | Leakage amount (ml/min) | | | | |
|---|---|---|---|---|---|
| | Number of times of mounting 1 | Number of times of mounting 100 | Number of times of mounting 200 | Number of times of mounting 300 | Number of times of mounting 400 |
| Samples A (protruding portion in outer periphery side region) | 0.30 | 0.32 | 0.5 | 2 | 10 |

TABLE 3-continued

| | Leakage amount (ml/min) | | | | |
|---|---|---|---|---|---|
| | Number of times of mounting 1 | Number of times of mounting 100 | Number of times of mounting 200 | Number of times of mounting 300 | Number of times of mounting 400 |
| Samples B (protruding portion in whole tapered surface area) | 0.30 | 0.31 | 0.31 | 0.35 | 0.32 |

As shown in Table 3, with the samples B wherein the helical protruding portion is provided over the whole area of the tapered surface, it has been found that it is possible to maintain good airtightness even when a plurality of times of mounting of each sample in the test bed are carried out. It is conceivable that this is because by virtue of the helical protruding portion being formed over a wide range, the helical protruding portion is more reliably in close contact with the test bed (bearing surface) over the whole circumference even when a deformation occurs in the test bed as a result of repeating the mounting. It is conceivable that it is possible to obtain the same working effects even when the annular protruding portions are formed.

It may be said from the heretofore described test results that in order to maintain good airtightness when a plurality of times of mounting are carried out too, it is preferable to provide the helical protruding portion or annular protruding portions over the whole area of the tapered surface.

Figure 11:
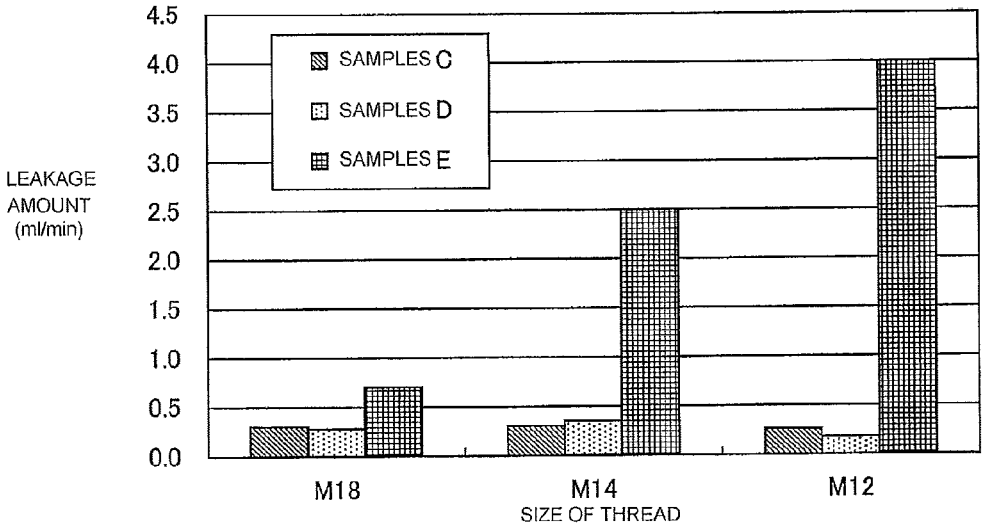
FIG. 11 is a graph showing a relationship between the size of a thread portion and a leakage amount.

Next, spark plug samples (samples C) wherein the helical protruding portion is provided over the whole area of the tapered surface, and the arithmetic mean roughness Ra of the surface of the tapered surface is set to 4 μm, spark plug samples (samples D) wherein the annular protruding portions are provided over the whole area of the tapered surface, and the arithmetic mean roughness Ra of the surface of the tapered surface is set to 4 μm, and spark plug samples (samples E) wherein no helical protruding portion or annular protruding portions are provided, and the arithmetic mean roughness Ra of the surface of the tapered surface is set to 4 μm by roughening the whole area of the tapered surface, are fabricated with the size of the thread portion of each sample set to M18, M14, or M12. Further, the heretofore described airtightness evaluation test is carried out on each sample with the air pressure set to 2 MPa. Table 4 and FIG. 11 show results of the test. In FIG. 11, graphs showing the test results of the samples C are hatched, graphs showing the test results of the samples D are dotted, and graphs showing the test results of the samples E are checkered.

TABLE 4

| | Leakage amount (ml/min) | | |
|---|---|---|---|
| | Size of thread M18 | Size of thread M14 | Size of thread M12 |
| Samples C | 0.3 | 0.3 | 0.26 |
| Samples D | 0.28 | 0.35 | 0.18 |
| Samples E | 0.7 | 2.5 | 4 |

As shown in Table 4 and FIG. 11, it has been revealed that the samples E provided with no helical protruding portion or annular protruding portions are such that airtightness decreases as the size of the thread portion decreases (that is, as the area of the tapered surface in contact with the bearing surface decreases), but that the samples C provided with the helical protruding portion and the samples D provided with the annular protruding portions are such that it is possible to ensure superior airtightness even when the size of the thread portion is set to M14 or M12 and the area of the tapered surface in contact with the bearing surface is small.

It may be said from the heretofore described test results that it is effective to provide the annular protruding portions or helical protruding portion on the tapered surface for a spark plug wherein a decrease in airtightness is liable to occur by the size of the thread portion being set to M14 or less, and that it is very effective to provide the annular protruding portions or helical protruding portion on the tapered surface for a spark plug wherein a decrease in airtightness is extremely liable to occur by the size of the thread portion being set to M12 or less.

A step of providing the helical protrusion portion and depression portion on a part of the receiving surface against which the tapered surface is pressed, and fixing the metal shell and insulator by forming the crimped portion on each metal shell with the size of the thread portion set to M18, M14, or M12 using each receiving die wherein the arithmetic mean roughness Ra of the part is variously changed (the pressing step), is carried out a plurality of times, and a rate of occurrence of an entrance (a bite) of the bearing surface into the insertion hole of the receiving die (an incidence of biting) is measured. Table 5 shows results of this test. A load when the metal shell is pressed toward the receiving die side by the pressing die is set to 55 kN when the size of thread is set to M18, to 40 kN when the size of thread is set to M14, and to 35 kN when the size of thread is set to M12.

TABLE 5

| Arithmetic mean | Incidence of biting (%) | | |
|---|---|---|---|
| roughness of receiving surface Ra (μm) | Size of thread M18 | Size of thread M14 | Size of thread M12 |
| 0.2 | 0.2 | 10 | 30 |
| 0.5 | 0 | 3 | 10 |
| 1 | 0 | 0 | 0 |
| 2 | 0 | 0 | 0 |
| 3 | 0 | 0 | 0 |
| 4 | 0 | 0 | 0 |
| 5 | 0 | 0 | 0 |
| 6 | 0 | 0 | 0 |

As shown in Table 5, it has been found that the incidence of biting is 0% when the arithmetic mean roughness Ra of a part of the receiving surface against which is pressed the tapered surface is set to 1 μm or more, and that it is possible to extremely effectively suppress a bite of the metal shell into the receiving die. It is conceivable that this is because the friction force between the receiving surface and tapered surface is sufficiently large, thus suppressing slippage of the tapered surface on the insertion hole side.

Also, it has been confirmed, from the test result when the arithmetic mean-roughness Ra is set to 0.2 μm or 0.5 μm, that the incidence of biting is high when the size of the thread portion is set to M14, and that the incidence of biting is extremely high when the size of the thread portion is set to M12. However, when the arithmetic mean roughness Ra of a part of the receiving surface against which is pressed the tapered surface is set to 1 μm or more, it is possible to effectively suppress a bite of the metal shell into the receiving die even under conditions that the bite of the meal shell is very liable to occur in this way.

The metal shell passed through the pressing step is such that the arithmetic mean roughness Ra of a part of the tapered surface in contact with the receiving surface is equal to the arithmetic mean roughness Ra of a part of the receiving surface against which the tapered surface is pressed. For example, when the arithmetic mean roughness Ra of a part of the receiving surface against which is pressed the tapered surface is set to 5 μm, the arithmetic mean roughness Ra of a part of the tapered surface in contact with the receiving surface is also 5 μm. Herein, it is preferable to set the arithmetic mean roughness Ra of the surface of the tapered surface to 5 μm or less in terms of ensuring good airtightness, as heretofore described (refer to Table 1 and FIG. 10). Consequently, with the spark plug manufactured through the pressing step, it may be said that it is preferable to set the arithmetic mean roughness Ra of a part of the receiving surface against which is pressed the tapered surface to 5 μm or less in terms of achieving a good close contact of the tapered surface with the bearing surface and ensuring superior airtightness.

It may be said from the heretofore described test results that, from the standpoint of ensuring superior airtightness in the manufactured spark plug while more reliably preventing a bite of the metal shell into the receiving die and realizing superior productivity, it is preferable that at least one portion of a part of the receiving surface against which is pressed the tapered surface, the arithmetic mean roughness of the surface of which is set to 1 μm or more and 5 μm or less, has at least either the annular protrusion portions and depression portions or helical protrusion portion and depression portion extending in the circumferential direction of the receiving surface.

Also, it may be said that the heretofore described configuration is particularly effective when a bite of the metal shell into the receiving die is more liable to occur by the size of the thread portion being set to M14 or less, and is very effective under conditions that a bite of the metal shell into the receiving die is extremely liable to occur by the size of the thread portion being set to M12 or less.

The invention, not being limited to the contents of the description of the heretofore described embodiment, may be implemented in, for example, the following ways. As a matter of course, other applications and modification examples not illustrated hereafter are also naturally possible.

a. In the heretofore described embodiment, the helical protruding portion 16P is formed over the whole area of the tapered surface 16, but the helical protruding portion 16P may be formed in at least the outer periphery side region 16C.

b. In the heretofore described embodiment, the protrusion portion 54 and depression portion 55 are formed over the whole area of apart of the receiving surface 53 against which the tapered surface 16 is pressed, but the protrusion portion 54 and depression portion 55 may be formed only in a part of the receiving surface 53 against which the outer periphery side region 16C is pressed.

c. In the heretofore described embodiment, the protrusion portion 54 and depression portion 55 are provided on the receiving surface 53, but only one of the protrusion portion or depression portion may be provided. In this case, in the pressing step, the helical protruding portion or annular protruding portions are formed by the tapered surface 16 entering groove-shaped portions provided between the depression portions or the protrusion portions.

d. In the heretofore described embodiment, in the pressing step, the insulator 2 and metal shell 3 are fixed by forming the crimped portion 20 (performing a so-called cool crimping) without heating the metal shell 3. As opposed to this, in the pressing step, the insulator 2 and metal shell 3 may be fixed by forming the crimped portion 20 (performing a so-called hot crimping) while electrically heating the metal shell 3. When performing the cool crimping, as it is necessary to apply a larger load to the metal shell 3 from the pressing die 56, as compared with when performing the hot crimping, a bite of the metal shell 3 into the receiving die 51 is liable to occur. Consequently, it is particularly significant to employ the technical idea of the invention when fixing the insulator 2 and metal shell 3 by performing the cool crimping in the pressing step.

e. In the heretofore described embodiment, the size of the thread portion 15 is set to M14 or less or M12 or less, but the size of the thread portion 15 is not limited to this.

f. In the heretofore described embodiment, a plated layer or a trivalent chromate layer is formed on the surface of the metal shell 3, but no plated layer or trivalent chromate layer may be formed. Also, the surface of the metal shell 3 may be coated with no anti-rust oil.

g. In the heretofore described embodiment, the case in which the ground electrode 27 is joined to the leading end portion of the metal shell 3 is embodied, but the technical idea of the invention may also be applied to a case in which a ground electrode is formed in such a way as to cut out one portion of a metal shell (or one portion of a leading end metal welded to the metal shell in advance) (for example, JP-A-2006-236906).

h. In the heretofore described embodiment, the tool engagement portion 19 is formed in a hexagonal cross-sectional shape, but the shape of the tool engagement portion 19 is not limited to this kind of shape. The tool engagement portion 19 may be formed in, for example, a Bi-HEX (modified dodecagon) shape [ISO22977:2005 (E)].

What is claimed is:

1. A spark plug, comprising:

a cylindrical insulator extending in a direction of an axis; and a cylindrical metal shell provided on the outer periphery of the insulator, the metal shell having:

a thread portion for threadedly engaging with a mounting hole of a combustion device; and a flanged seat portion, having a tapered surface whose outer diameter decreases gradually toward a leading end side, which is positioned closer to a rear end side than the thread portion, wherein the tapered surface coming into contact with a bearing surface of the combustion device when the thread portion is threadedly engaged with the mounting hole of the combustion device, annular protruding portions, or a helical protruding portion having the length of one or more turns, extending in a circumferential direction of the metal shell, is formed within at least a range on the tapered surface from an outermost peripheral portion to a part forming an outer diameter occupying 95% of the outer diameter of the outermost peripheral portion, and the arithmetic mean roughness of a surface of the tapered surface within the range is set to 1 μm or more and 5 μm or less on a section including the axis.

2. The spark plug according to claim 1, wherein the annular protruding portions or helical protruding portion is formed in a whole area of the tapered surface, and the arithmetic mean roughness of the surface of the tapered surface is set to 1 μm or more and 5 μm or less.

3. The spark plug according to claim 1, wherein the size of the thread portion is M14 or less.

4. The spark plug according to claim 1, wherein the size of the thread portion is M12 or less.

5. A method of manufacturing a spark plug comprising:

a cylindrical insulator extending in a direction of an axis; and a cylindrical metal shell provided on the outer periphery of the insulator, the metal shell including:

a thread portion for threadedly engaging with a mounting hole of a combustion device; and a flanged seat portion, having a tapered surface whose outer diameter decreases gradually toward a leading end side, which is positioned closer to a rear end side than the thread portion, wherein the tapered surface coming into contact with a bearing surface of the combustion device when the thread portion is threadedly engaged with the mounting hole of the combustion device, the method comprising:

a pressing step which, using a receiving die having an insertion hole into which the thread portion is capable of being inserted and an annular receiving surface continuing with an opening of the insertion hole, presses the tapered surface against the receiving surface by pressing the metal shell toward the receiving die side while inserting the thread hole into the insertion hole, wherein at least one portion of a part of the receiving surface against which the tapered surface is pressed has an arithmetic mean roughness of the surface of which is set to 1 μm or more and 5 μm or less, and includes at least either annular protrusion portions and depression portions, or a helical protrusion portion and depression portion having the length of one or more turns, extending in a circumferential direction of the receiving surface, and in the pressing step, by pressing the tapered surface against the receiving surface, annular protruding portions, or a helical protruding portion having the length of one or more turns, extending in a circumferential direction of the metal shell, is formed on the tapered surface.

6. The spark plug manufacturing method according to claim 5, wherein in the spark plug, the insulator and metal shell are fixed by a crimped portion, bent radially inward, which is provided in a rear end portion of the metal shell, and in the pressing step, by pressing the rear end portion of the metal shell, the rear end portion of the metal shell is bent radially inward to form the crimped portion, and the tapered surface is pressed against the receiving surface to form the annular protruding portions or helical protruding portion.

7. The spark plug manufacturing method according to claim 5, wherein the size of the thread portion is M14 or less.

8. The spark plug manufacturing method according to claim 5, wherein the size of the thread portion is M12 or less.

9. The spark plug according to claim 2, wherein the size of the thread portion is M14 or less.

10. The spark plug according to claim 2, wherein the size of the thread portion is M12 or less.

11. The spark plug according to claim 3, wherein the size of the thread portion is M12 or less.

12. The spark plug manufacturing method according to claim 6, wherein the size of the thread portion is M14 or less.

13. The spark plug manufacturing method according to claim 6, wherein the size of the thread portion is M12 or less.

14. The spark plug manufacturing method according to claim 7, wherein the size of the thread portion is M12 or less.

15. The spark plug according to claim 1, wherein the cylindrical insulator and the cylindrical metal shell have hollow structures.

16. The spark plug manufacturing method according to claim 5, wherein the cylindrical insulator and the cylindrical metal shell have hollow structures.

* * * * *